US012415593B2

(12) United States Patent
Kuribayashi et al.

(10) Patent No.: US 12,415,593 B2
(45) Date of Patent: Sep. 16, 2025

(54) RUDDER

(71) Applicant: KAY SEVEN CO., LTD., Tokyo (JP)

(72) Inventors: Sadatomo Kuribayashi, Tokyo (JP); Noriyuki Sasaki, Tokyo (JP)

(73) Assignee: Kay Seven Co., LTD., Tokyo (JP)

( * ) Notice: Subject to any disclaimer, the term of this patent is extended or adjusted under 35 U.S.C. 154(b) by 483 days.

(21) Appl. No.: 18/011,813

(22) PCT Filed: Jul. 26, 2021

(86) PCT No.: PCT/JP2021/027488
§ 371 (c)(1),
(2) Date: Dec. 20, 2022

(87) PCT Pub. No.: WO2022/044644
PCT Pub. Date: Mar. 3, 2022

(65) Prior Publication Data

US 2023/0249796 A1 Aug. 10, 2023

(30) Foreign Application Priority Data

Aug. 27, 2020 (JP) ..... 2020-143796

(51) Int. Cl.
*B63H 25/38* (2006.01)
*B63H 11/107* (2006.01)

(52) U.S. Cl.
CPC ..... *B63H 25/38* (2013.01); *B63H 11/107* (2013.01)

(58) Field of Classification Search
CPC ..... B63H 25/00; B63H 25/06; B63H 25/38; B63H 11/107; B63H 1/28; B63H 2025/066; B63H 25/382; B63H 5/08
(Continued)

(56) References Cited

U.S. PATENT DOCUMENTS 3,872,817 A * 3/1975 Duryea ..... B63H 25/06 114/163
4,895,093 A 1/1990 Dalsbo
2017/0081010 A1 3/2017 Kuribayashi et al.

FOREIGN PATENT DOCUMENTS

CN 208828079 5/2019
JP H01501384 A 5/1989
(Continued)

OTHER PUBLICATIONS

International Search Report for PCT/JP2021/027488, Dated Sep. 7, 2021.

*Primary Examiner* — Anthony D Wiest
(74) *Attorney, Agent, or Firm* — Lippes Mathias LLP

(57) ABSTRACT

Provided is a rudder assembly producing significant thrust to reduce energy consumption of vessels during voyage. The rudder assembly is formed of first/second rudder units arranged on both sides of first/second propellers. As seen from rear, each first/second rudder unit is formed of left/right rudders arranged on the left/right of the first/second propeller. Each left/right rudder of the first/second rudder units is formed of a first left/right rudder portion extending in the right-left direction, a second left/right rudder portion curved from the left/right end of the first left/right rudder portion toward lower left/right, and a third left/right rudder portion extending downwards from the lower end of the second left/right rudder portion. The first left/right rudder portions of the first/second rudder unit are arranged spaced upwardly apart from the upper edge of the tip circle of the first/second propeller for a distance of 10-20% of the diameter of the first/second propeller.

14 Claims, 11 Drawing Sheets

(58) Field of Classification Search
USPC ..... 114/144 R, 162, 163, 164, 165
See application file for complete search history.

(56) References Cited

FOREIGN PATENT DOCUMENTS

| | | | | |
|---|---|---|---|---|
| JP | 2014073815 | A | * | 4/2014 |
| JP | 2016097711 | A | | 5/2016 |
| JP | 2020090233 | A | | 6/2020 |
| KR | 20140106167 | A | | 9/2014 |

* cited by examiner

[FIG.1]
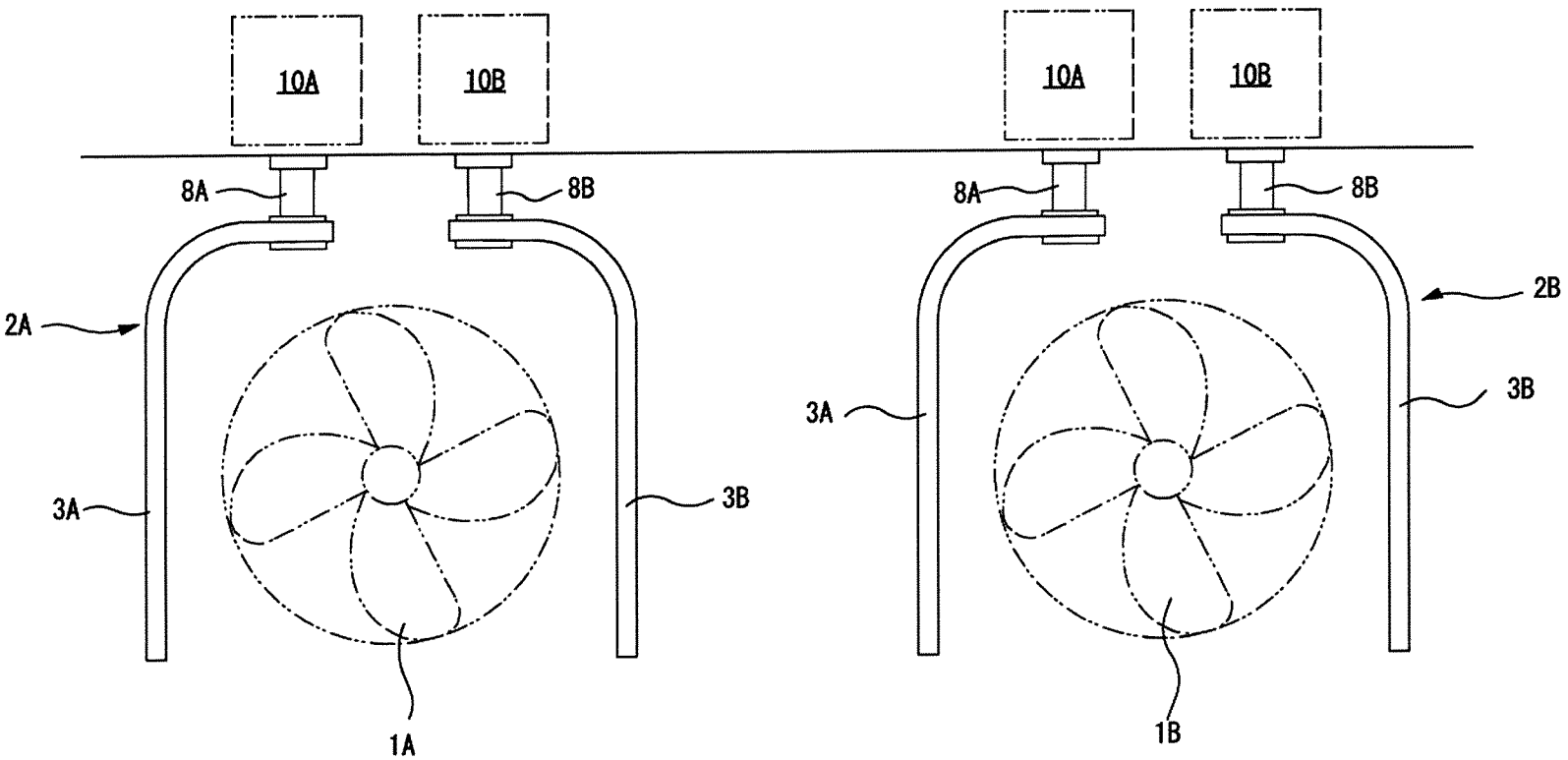

[FIG.2]
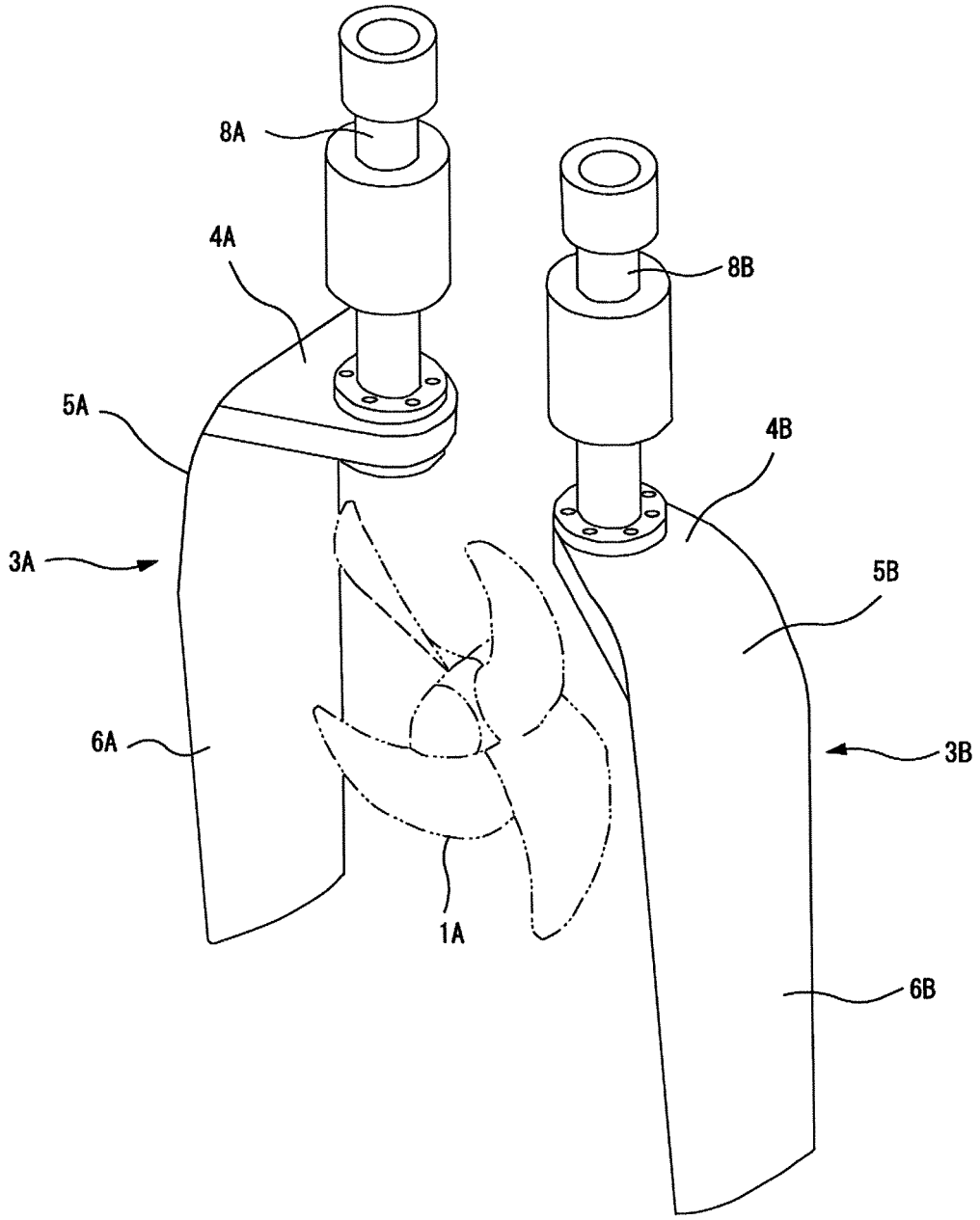

[FIG.3]
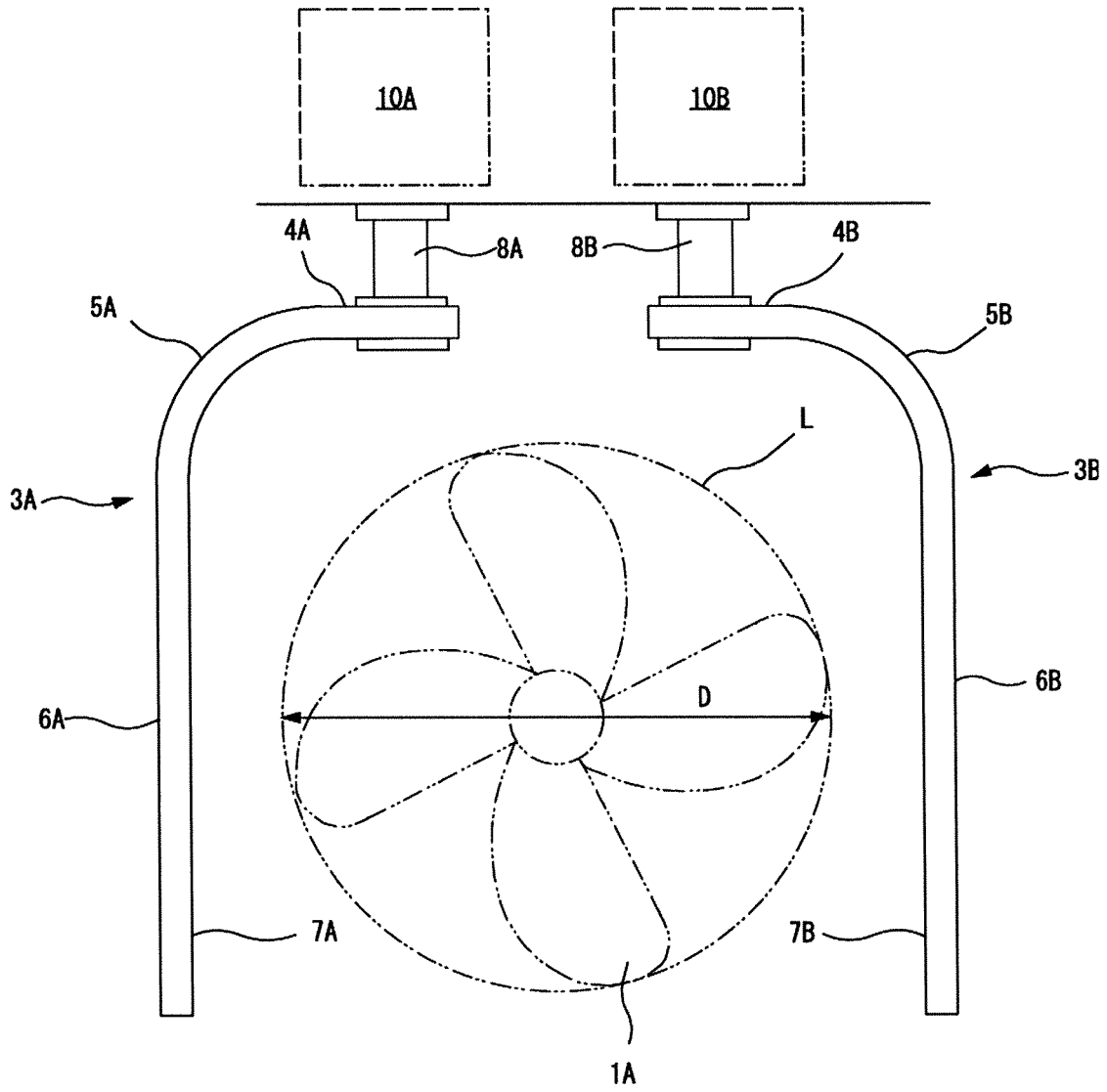

[FIG.4]
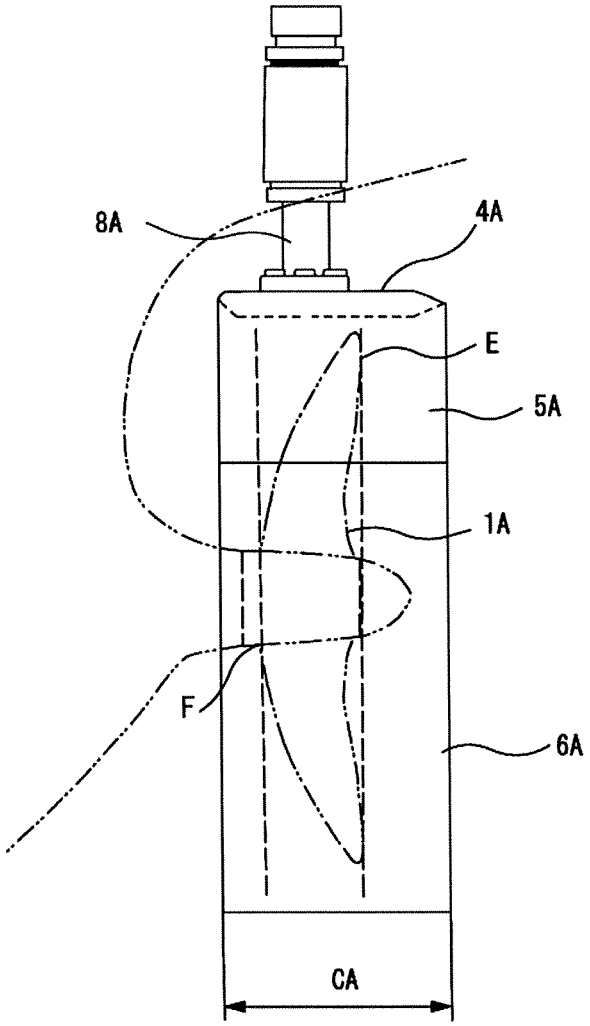

[FIG.5]
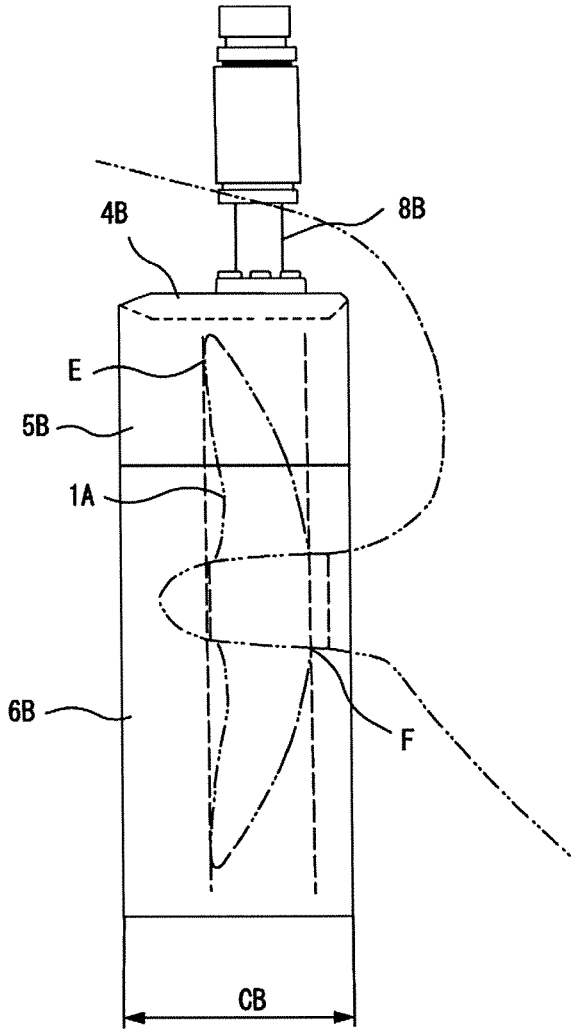

[FIG.6]
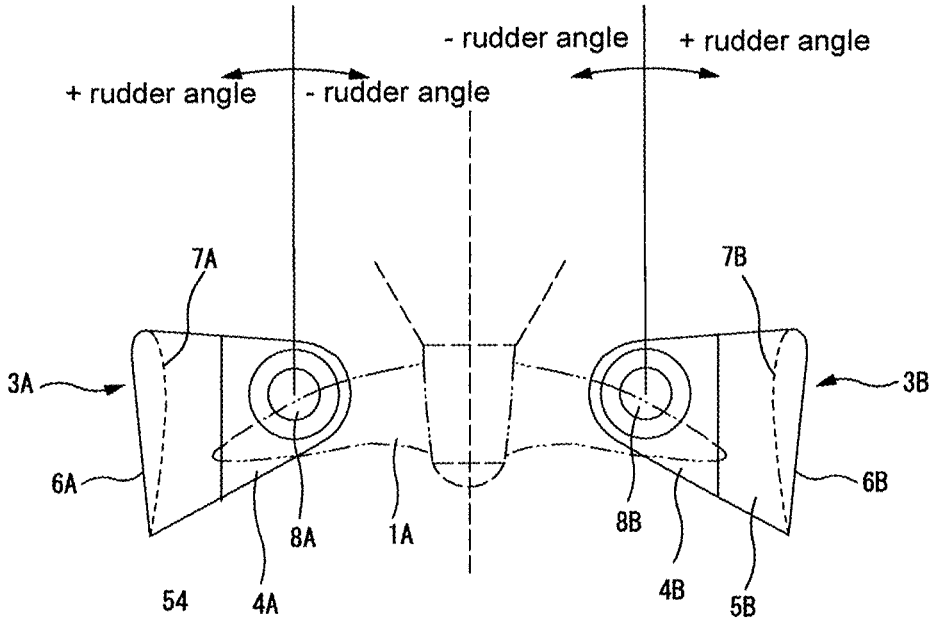

[FIG.7]
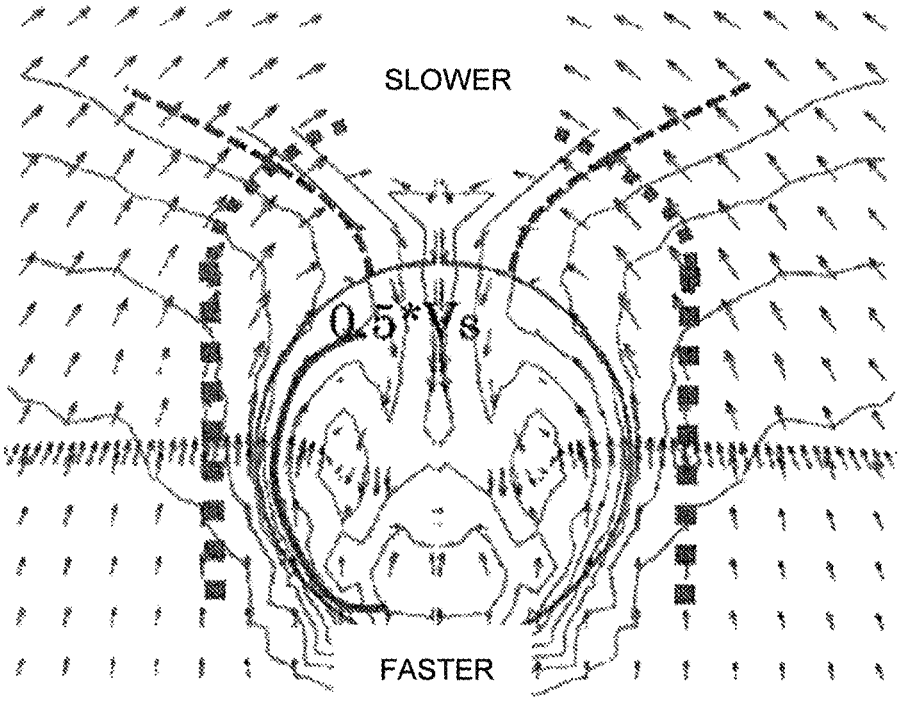

[Fig. 8]
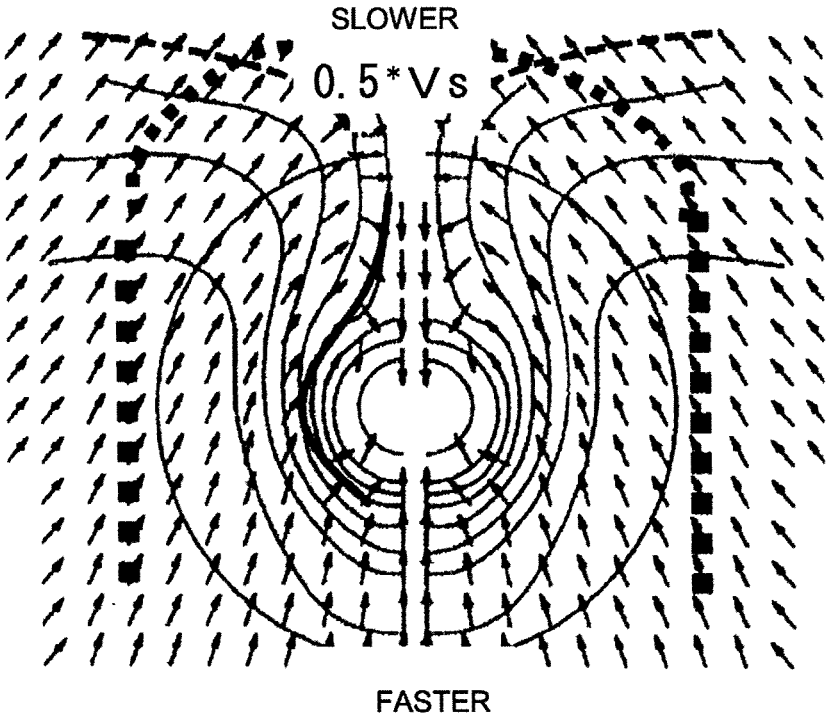

[Fig. 9]
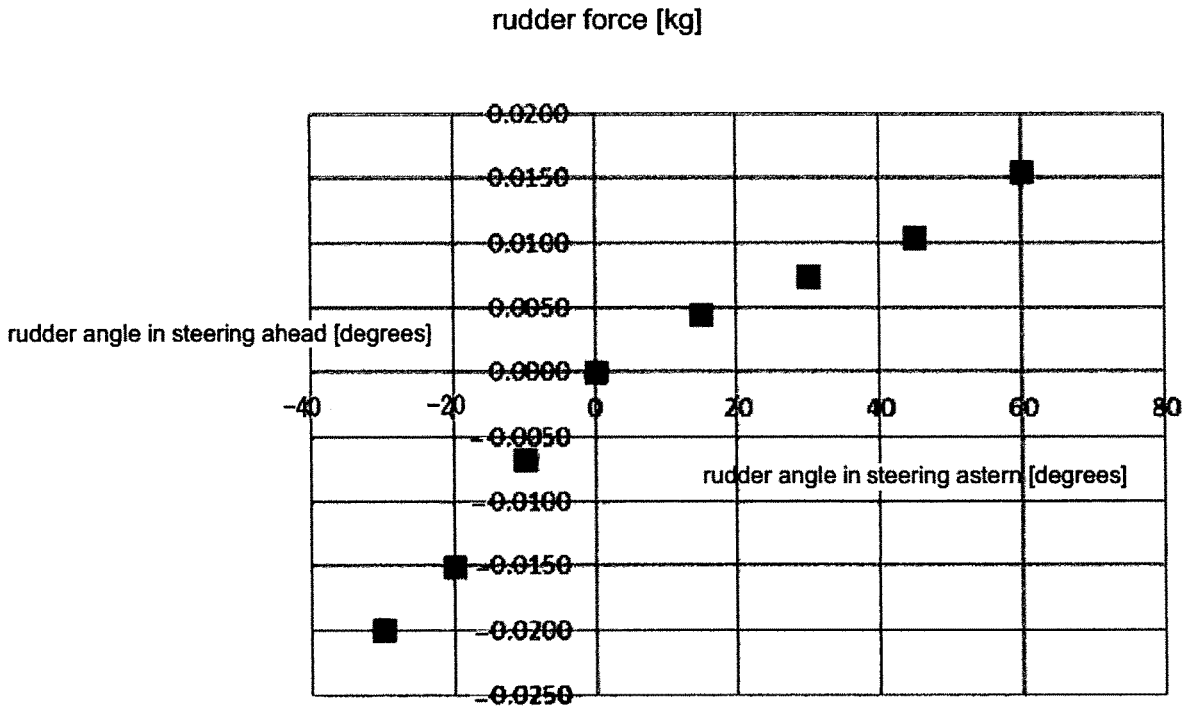

[FIG.10]
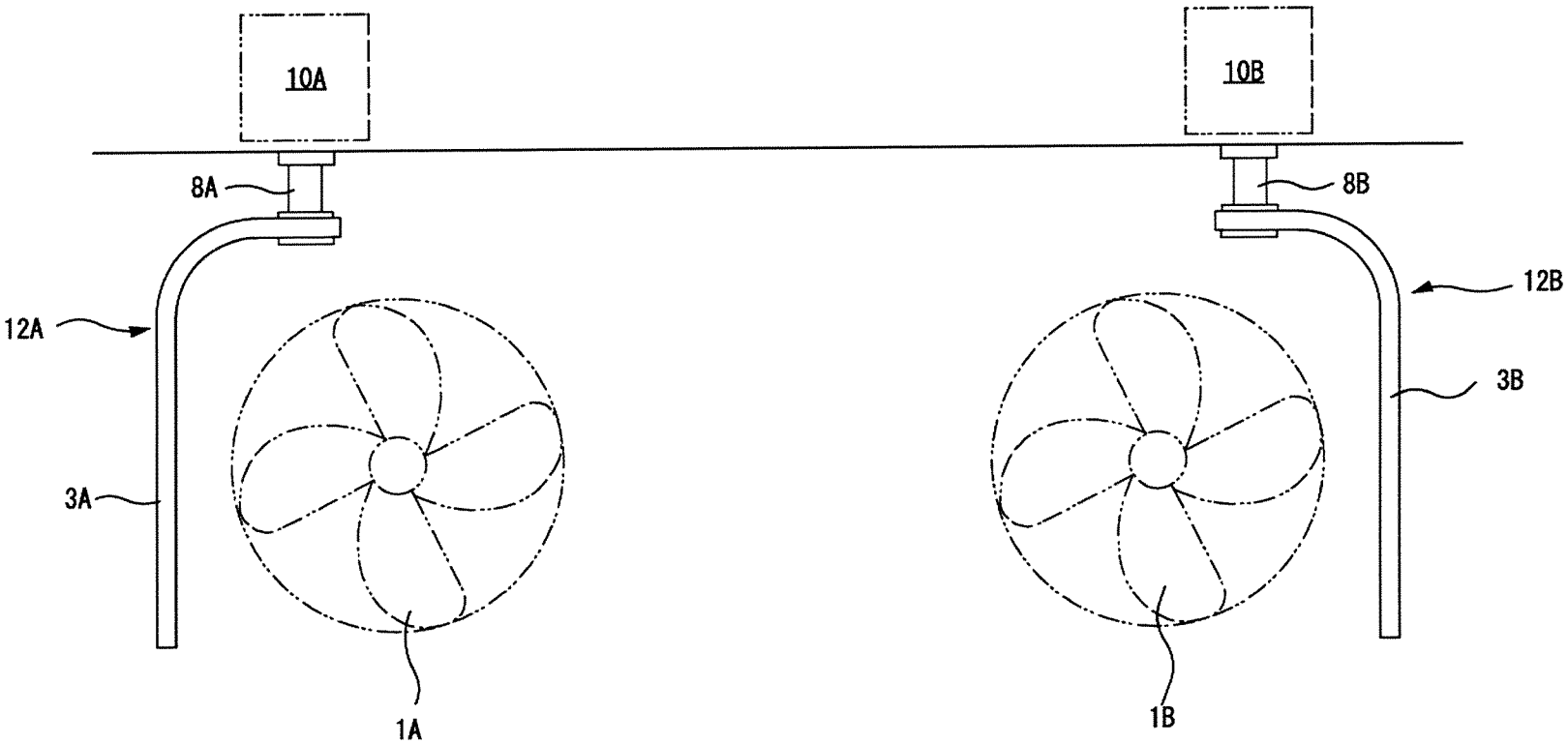

[FIG.11]
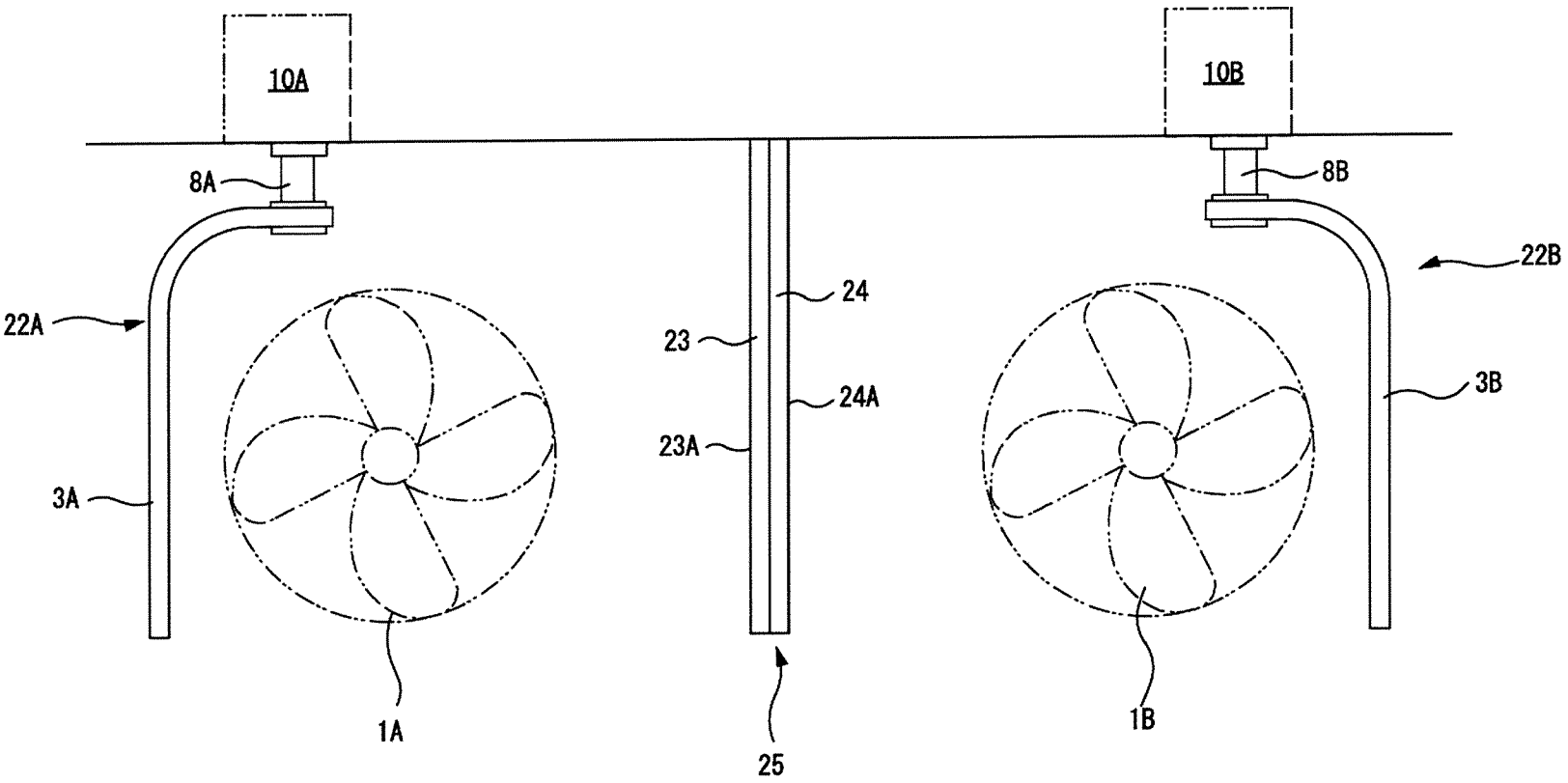

RUDDER

FIELD OF ART

The present invention relates to a rudder assembly to be provided with respect to a pair of right and left propellers aligned at the same front-back position, of a twin-screw vessel.

BACKGROUND ART

There is conventionally known a technique to arrange a rudder behind and centrally between a pair of right and left propellers aligned at the same front-back position, of a twin-screw vessel (Patent Publication 1).

There is also known a technique of a ducted propeller including right and left rudders arranged on the opposite sides, respectively, of a propeller in an approximately arcuate shape along the tip circle area of the propeller for accelerating the jet flow out of the propeller (Patent Publication 2).

PRIOR ART PUBLICATION

Patent Publication

Patent Publication 1: JP 2016-097711 A
Patent Publication 2: JP H01-501384 A

SUMMARY OF THE INVENTION

Problem to be Solved by the Invention

According to the technique of Patent Publication 1, however, while the vessel is sailing straight, the rudder arranged behind and centrally between the pair of right and left propellers faces resistance, and sufficient reduction in energy consumption of the vessel during the voyage cannot be achieved.

According to the technique of Patent Publication 2, the clearance between the propeller and the right/left rudders is limited for enhanced efficiency of the duct, which may lead to erosion by cavitation on the inner surfaces of the right and left rudders.

It is therefore a primary object of the present invention to provide a rudder assembly that produces significant thrust in order to reduce energy consumption of a vessel during the voyage. It is also an object of the present invention to provide a rudder assembly that regulates rudder erosion by suppressing cavitation in the vicinity of the rudder assembly.

Means for Solving the Problem

The present invention that solves the above problems is as follows.

The invention according to claim 1 is a rudder assembly to be arranged on a side of first and second propellers provided at a stern of a vessel at a distance in a right-left direction from each other and aligned at a same front-back position, the rudder assembly including:

a first rudder unit to be arranged on both sides of the first propeller; and a second rudder unit to be arranged on both sides of the second propeller, wherein the first rudder unit is composed of, as seen from rear, a left rudder to be arranged on a left of the first propeller and a right rudder to be arranged on a right of the first propeller, wherein the second rudder unit is composed of, as seen from rear, a left rudder to be arranged on a left of the second propeller and a right rudder to be arranged on a right of the second propeller, wherein each left rudder of the first and second rudder units has, as seen from rear, a first left rudder portion extending in the right-left direction, a second left rudder portion curved from a left end of the first left rudder portion toward lower left, and a third left rudder portion extending downwards from a lower end of the second left rudder portion, wherein each right rudder of the first and second rudder units has, as seen from rear, a first right rudder portion extending in the right-left direction, a second right rudder portion curved from a right end of the first right rudder portion toward lower right, and a third right rudder portion extending downwards from a lower end of the second right rudder portion, wherein, as seen from rear, lower surfaces of the first left rudder portion and the first right rudder portion of the first rudder unit are arranged at positions spaced upwardly apart from an upper edge of a tip circle line of the first propeller for a distance of 10 to 20% of a diameter of the first propeller, and wherein, as seen from rear, lower surfaces of the first left rudder portion and the first right rudder portion of the second rudder unit are arranged at positions spaced upwardly apart from an upper edge of a tip circle line of the second propeller for a distance of 10 to 20% of a diameter of the second propeller.

The invention according to claim 2 is the rudder assembly according to claim 1, further including a left rudder shaft and a right rudder shaft provided in the first left rudder portion and the first right rudder portion, respectively, of the first rudder unit, wherein, as seen from side, dimensions in a front-back direction of the third left rudder portion and the third right rudder portion of the first rudder unit are 40 to 100% of the diameter of the first propeller, the first propeller is arranged within 15 to 65% of the dimension in the front-back direction from leading edges of the third left rudder portion and the third right rudder portion of the first rudder unit, and the left rudder shaft and the right rudder shaft of the first rudder unit are located within 30 to 50% the dimension in the front-back direction from the leading edges of the third left rudder portion and the third right rudder portion, respectively, of the first rudder unit, the rudder assembly further including a left rudder shaft and a right rudder shaft provided in the first left rudder portion and the first right rudder portion, respectively, of the second rudder unit, wherein, as seen from side, dimensions in a front-back direction of the third left rudder portion and the third right rudder portion of the second rudder unit are 40 to 100% of the diameter of the second propeller, the second propeller is arranged within 15 to 65% of the dimension in the front-back direction from leading edges of the third left rudder portion and the third right rudder portion of the second rudder unit, and the left rudder shaft and the right rudder shaft of the second rudder unit are located within 30 to 50% the dimension in the front-back direction of the third left rudder portion and the third right rudder portion, respectively, of the second rudder unit from leading edges thereof.

The invention according to claim 3 is the rudder assembly according to claim 1 or 2, wherein, as seen from rear, a distance between an inner right surface of the third left rudder portion of the first rudder unit and a left edge of the tip circle line of the first propeller, and a distance between an inner left surface of the third right rudder portion of the first rudder unit and a right edge of the tip circle line of the first propeller are 4 to 10% of the diameter of the first propeller, and wherein, as seen from rear, a distance between an inner right surface of the third left rudder portion of the second rudder unit and a left edge of the tip circle line of the second propeller, and a distance between an inner left surface of the third right rudder portion of the second rudder unit and a right edge of the tip circle line of the second propeller are 4 to 10% of the diameter of the second propeller.

The invention according to claim 4 is the rudder assembly according to any one of claims 1 to 3, wherein, as seen from rear, lower ends of the third left rudder portion and the third right rudder portion of the first rudder unit are positioned below a shaft center of the first propeller, and wherein, as seen from rear, lower ends of the third left rudder portion and the third right rudder portion of the second rudder unit are positioned below a shaft center of the second propeller.

The invention according to claim 5 is the rudder assembly according to any one of claims 1 to 4, wherein, as seen from rear, the first rudder unit is composed of the left rudder to be arranged on a left of the first propeller, and wherein, as seen from rear, the second rudder unit is composed of the right rudder to be arranged on a right of the second propeller.

The invention according to claim 6 is the rudder assembly according to claim 5, including:

a fixed rudder having a rudder shaft and a rudder plate in a same plane, and provided between the left rudder of the first rudder unit and the right rudder of the second rudder unit, wherein, as seen from rear, the fixed rudder is positioned in a middle of the right-left direction between the first propeller and the second propeller.

The invention according to claim 7 is the rudder assembly according to claim 1, wherein, as seen from side, a leading part and a trailing part of the third left rudder portion of the first rudder unit are formed downwardly linearly from a lower end of the second left rudder portion of the first rudder unit, whereas a leading part and a trailing part of the third right rudder portion of the first rudder unit are formed downwardly linearly from a lower end of the second right rudder portion of the first rudder unit, and wherein, as seen from side, a leading part and a trailing part of the third left rudder portion of the second rudder unit are formed downwardly linearly from a lower end of the second left rudder portion of the second rudder unit, whereas a leading part and a trailing part of the third right rudder portion of the second rudder unit are formed downwardly linearly from a lower end of the second right rudder portion of the second rudder unit.

Effect of the Invention

According to the invention of claim 1, the rudder assembly includes a first rudder unit to be arranged on both sides of the first propeller and a second rudder unit to be arranged on both sides of the second propeller; the first rudder unit is composed of, as seen from rear, a left rudder to be arranged on the left of the first propeller and a right rudder to be arranged on the right of the first propeller; the second rudder unit is composed of, as seen from rear, a left rudder to be arranged on the left of the second propeller and a right rudder to be arranged on the right of the second propeller; each left rudder of the first and second rudder units having, as seen from rear, a first left rudder portion extending in the right-left direction, a second left rudder portion curved from the left end of the first left rudder portion toward lower left, and a third left rudder portion extending downwards from the lower end of the second left rudder portion; each right rudder of the first and second rudder units having, as seen from rear, a first right rudder portion extending in the right-left direction, a second right rudder portion curved from the right end of the first right rudder portion toward lower right, and a third right rudder portion extending downwards from the lower end of the second right rudder portion; as seen from rear, the lower surfaces of the first left rudder portion and the first right rudder portion of the first rudder unit are arranged at positions spaced upwardly apart from the upper edge of the tip circle line of the first propeller for a distance of 10 to 20% of the diameter of the first propeller; and as seen from rear, the lower surfaces of the first left rudder portion and the first right rudder portion of the second rudder unit are arranged at positions spaced upwardly apart from the upper edge of the tip circle line of the second propeller for a distance of 10 to 20% of the diameter of the second propeller. Accordingly, larger thrust may be produced on the first left rudder portion and the first right rudder portion of the first rudder unit and on the first left rudder portion and the first right rudder portion of the second rudder unit, compared to the one produced in the duct upper part of the ducted propeller, and thrust may be produced on the second left rudder portion and the second right rudder portion of the first rudder unit and on the second left rudder portion and the second right rudder portion of the second rudder unit, equivalent to the one produced on both sides of the duct upper part of the ducted propeller, so that energy consumption of a vessel during the voyage may be reduced. Further, cavitation may be prevented to inhibit erosion of the first and second rudder units. In addition, the third left rudder portion of the first rudder unit and the second right rudder portion of the second rudder unit are arranged spaced apart from each other in the right-left direction, so that the vessel may efficiently be kept from rolling.

According to the invention of claim 2, a left rudder shaft and a right rudder shaft are provided in the first left rudder portion and the first right rudder portion, respectively, of the first rudder unit; as seen from side, the dimensions in the front-back direction of the third left rudder portion and the third right rudder portion of the first rudder unit are 40 to 100% of the diameter of the first propeller; the first propeller is arranged within 15 to 65% of the dimension in the front-back direction from the leading edges of the third left rudder portion and the third right rudder portion of the first rudder unit; the left rudder shaft and the right rudder shaft of the first rudder unit are located within 30 to 50% the dimension in the front-back direction of the third left rudder portion and the third right rudder portion, respectively, of the first rudder unit from the leading edges thereof; a left rudder shaft and a right rudder shaft are provided in the first left rudder portion and the first right rudder portion, respectively, of the second rudder unit; as seen from side, the dimensions in the front-back direction of the third left rudder portion and the third right rudder portion of the second rudder unit are 40 to 100% of the diameter of the second propeller; the second propeller is arranged within 15 to 65% of the dimension in the front-back direction from the leading edges of the third left rudder portion and the third right rudder portion of the second rudder unit, and the left rudder shaft and the right rudder shaft of the second rudder unit are located within 30 to 50% the dimension in the front-back direction of the third left rudder portion and the third right rudder portion, respectively, of the second rudder unit from the leading edges thereof. Accordingly, in addition to the effects of the invention of claim 1, a larger thrust may be produced on the third left rudder portion and the third right rudder portion of the first rudder unit and on the third left rudder portion and the third right rudder portion of the second rudder unit, so that energy consumption of a vessel during the voyage may further be reduced. Further, the turning torques may be rendered smaller on the left rudder shaft and the right rudder shaft of the first rudder unit and on the left rudder shaft and the right rudder shaft of the second rudder unit and, when the third left rudder portion and the third right rudder portion of the first rudder unit and the third left rudder portion and the third right rudder portion of the second rudder unit are in their ahead positions, a large thrust may be produced to efficiently stop the vessel.

According to the invention of claim 3, as seen from rear, the distance between the inner right surface of the third left rudder portion of the first rudder unit and the left edge of the tip circle line of the first propeller, and the distance between the inner left surface of the third right rudder portion of the first rudder unit and the right edge of the tip circle line of the first propeller are 4 to 10% of the diameter of the first propeller; and as seen from rear, the distance between the inner right surface of the third left rudder portion of the second rudder unit and the left edge of the tip circle line of the second propeller, and the distance between the inner left surface of the third right rudder portion of the second rudder unit and the right edge of the tip circle line of the second propeller are 4 to 10% of the diameter of the second propeller. Accordingly, in addition to the effects of the invention of claim 1 or 2, large thrusts are produced under the Coanda effect on the leading part of, and under the USB effect on the trailing part of, the third left rudder portion and the third right rudder portion of the first rudder unit and the third left rudder portion and the third right rudder portion of the second rudder unit, which may further reduce energy consumption of the vessel during the voyage.

According to the invention of claim 4, as seen from rear, the lower ends of the third left rudder portion and the third right rudder portion of the first rudder unit are positioned below the shaft center of the first propeller and, as seen from rear, the lower ends of the third left rudder portion and the third right rudder portion of the second rudder unit are positioned below the shaft center of the first propeller. Accordingly, in addition to the effects of the invention of any one of claims 1 to 3, while the vessel is sailing straight, the third left rudder portion and the third right rudder portion of the first rudder unit and the third left rudder portion and the third right rudder portion of the second rudder unit may be suppressed from acting as a resistance to sailing of the vessel.

According to the invention of claim 5, as seen from rear, the first rudder unit is composed of the left rudder to be arranged on the left of the first propeller and, as seen from rear, the second rudder unit is composed of the right rudder to be arranged on the right of the second propeller. Accordingly, in addition to the effects of the invention of any one of claims 1 to 4, while the vessel is sailing straight, the first rudder unit and the second rudder unit may further be suppressed from acting as a resistance to sailing of the vessel. Further, a wider range of motion through a rudder angle may be allowed for the left rudder of the first rudder unit and the right rudder of the second rudder unit.

According to the invention of claim 6, a fixed rudder having a rudder shaft and a rudder plate in a same plane is provided between the left rudder of the first rudder unit and the right rudder of the second rudder unit and, as seen from rear, the fixed rudder is positioned in the middle of the right-left direction between the first propeller and the second propeller. Accordingly, in addition to the effects of the invention of claim 5, thrust is produced on the fixed rudder, so that energy consumption of the vessel during the voyage may be reduced.

BRIEF DESCRIPTION OF THE DRAWINGS

FIG. 1 is a rear view of the first and second rudder units of the rudder assembly according to the first embodiment, provided around the tip circles of the right and left propellers, respectively, in a pair at the stern of a vessel.

FIG. 2 is a perspective view of the first rudder unit of the rudder assembly according to the first embodiment.

FIG. 3 is a rear view of the first rudder unit.

FIG. 4 is a left side view of the first rudder unit.

FIG. 5 is a right side view of the first rudder unit.

FIG. 6 is a plan view of the first rudder unit.

FIG. 7 illustrates simulation of water flow velocities in the vicinity of the rudder unit provided on a tanker ship.

FIG. 8 illustrates simulation of water flow velocities in the vicinity of the rudder unit provided on a containership.

FIG. 9 shows measured rudder force values when the first rudder unit is turned through a negative rudder angle (steered ahead) and through a positive rudder angle (steered astern).

FIG. 10 is a rear view of the first and second rudder units of the rudder assembly according to the second embodiment, provided around the tip circles of the right and left propellers, respectively, in a pair at the stern of a vessel.

FIG. 11 is a rear view of the first and second rudder units of the rudder assembly according to the third embodiment, provided around the tip circles of the right and left propellers, respectively, in a pair at the stern of a vessel.

As shown in FIG. 1, at the stern of a vessel, a first propeller 1A and a second propeller 1B are provided at a distance in the right-left direction from each other. In this way, even in high-speed sailing, necessary thrust may be obtained without excessively increasing the rotational speeds of the first propeller 1A and the second propeller 1B, so that the cavitation is suppressed and erosion of the first propeller 1A and the second propeller 1B may be inhibited.

The first propeller 1A and the second propeller 1B are formed in the same shape. As used herein, the first propeller 1A and the second propeller 1B are collectively referred to as propeller 1.

RUDDER ASSEMBLY ACCORDING TO FIRST EMBODIMENT

Next, the rudder assembly according to the first embodiment is discussed. As shown in FIG. 1, a first rudder unit 2A constituting a rudder assembly according to the first embodiment is provided around the tip circle of the first propeller 1A, and a second rudder unit 2B constituting the rudder assembly according to the first embodiment is provided around the tip circle of the second propeller 1B.

The first rudder unit 2A and the second rudder unit 2B are configured in the same form. As used herein, the first rudder unit 2A and the second rudder unit 2B are collectively referred to as rudder unit 2.

The first rudder unit 2A is composed of a left rudder 3A arranged on the left of the first propeller 1A and a right rudder 3B arranged on the right of the first propeller 1A. The second rudder unit 2B is composed of a left rudder 3A arranged on the left of the second propeller 1B and a right rudder 3B arranged on the right of the second propeller 1B. The right rudder 3B of the first rudder unit 2A and the left rudder 3A of the second rudder unit 2B are arranged at a distance in the right-left direction from each other so as not to interfere with each other upon turning.

In the right-left direction, the first rudder unit 2A is disposed leftward of the center of the vessel whereas the second rudder unit 2B is disposed rightward of the center of the vessel, and in particular, the left rudder 3A of the first rudder unit 2A is disposed at a position shifted to the port side of the vessel center whereas the right rudder 3B of the second rudder unit 2B is disposed at a position shifted to the starboard side of the vessel center. In this way, when the vessel sways from side to side (rolling), the left rudder 3A of the first rudder unit 2A and the right rudder 3B of the second rudder unit 2B function like a fin stabilizer to efficiently suppress rolling of the vessel, even more efficiently than in a short-axis vessel.

The left rudder 3A and the right rudder 3B of the first rudder unit 2A will now be discussed. Note that the left rudder 3A and the right rudder 3B of the second rudder unit 2B are formed in the same shapes as those of the left rudder 3A and the right rudder 3B of the first rudder unit 2A, so that explanation thereof is omitted.

As shown in FIG. 2, the left rudder 3A of the first rudder unit 2A is formed of a first left rudder portion 4A extending in the right-left direction, a second left rudder portion 5A curved from the left end of the first left rudder portion 4A toward lower left, and a third left rudder portion 6A extending downwards from the lower end of the second left rudder portion 5A.

In the right end of the first left rudder portion 4A is provided a left rudder shaft 8A extending vertically. The upper portion of the left rudder shaft 8A extends into the engine room of the vessel and is connected to a left steering machine 10A.

The right rudder 3B of the first rudder unit 2A is formed of a first right rudder portion 4B extending in the right-left direction, a second right rudder portion 5B curved from the right end of the first right rudder portion 4B toward lower right, and a third right rudder portion 6B extending downwards from the lower end of the second right rudder portion 5B.

In the left end of the first right rudder portion 4B is provided a right rudder shaft 8B extending vertically. The upper portion of the right rudder shaft 8B extends into the engine room of the vessel and is connected to a right steering machine 10B. As used herein, the left steering machine 10A and the right steering machine 10B are collectively referred to as steering machine 10.

As shown in FIG. 3, in the vertical direction, the lower surfaces of the first left rudder portion 4A and the first right rudder portion 4B of the first rudder unit 2A are preferably located at positions spaced upwardly apart from the upper edge of the tip circle line L of the first propeller 1A for a distance of 10 to 20% of the diameter D of the propeller 1.

As shown in FIGS. 7 and 8, the velocity of the water flow flowing above the first propeller 1A is lower than the velocity of the water flow flowing below the first propeller 1A. In this way, with the lower surfaces of the first left rudder portion 4A and the first right rudder portion 4B arranged at positions spaced upwardly apart from the upper edge of the tip circle line L of the first propeller 1A for a distance of 10 to 20% of the diameter D of the propeller 1, a larger thrust may be produced on the first left rudder portion 4A and the first right rudder portion 4B, compared to the thrust produced in the middle of the upper part of the duct of the ducted propeller arranged along the tip circle line L of the propeller.

As shown in FIG. 3, in the right-left direction, the inner right surface 7A of the third left rudder portion 6A is preferably located at a position spaced leftwards apart from the left edge of the tip circle line L of the first propeller 1A for a distance of 4 to 10% of the diameter D of the first propeller 1A. In this way, while the vessel is sailing straight, significant thrust is produced on the leading part of the third left rudder portion 6A extending forward of the first propeller 1A by the suction flow into the first propeller 1A under the Coanda effect, whereas significant thrust is produced on the trailing part of the third left rudder portion 6A extending rearward of the first propeller 1A by the jet flow out of the first propeller 1A under the USB effect, so that significant thrust (lift) for moving the vessel ahead is produced.

Similarly, the inner left surface 7B of the third right rudder portion 6B is preferably located at a position spaced rightwards apart from the right edge of the tip circle line L of the first propeller 1A for a distance of 4 to 10% of the diameter D of the first propeller 1A.

In this way, while the vessel is sailing straight, significant thrust is produced on the leading part of the third right rudder portion 6B extending forward of the first propeller 1A by the suction flow into the first propeller 1A under the Coanda effect, whereas significant thrust is produced on the trailing part of the third right rudder portion 6B extending rearward of the first propeller 1A by the jet flow out of the first propeller 1A under the USB effect, so that significant thrust (lift) for moving the vessel ahead is produced.

In the vertical direction, the lower ends of the third left rudder portion 6A and the third right rudder portion 6B are preferably positioned below the shaft center of the first propeller 1A, in the vicinity of the lower edge of the tip circle line L of the first propeller 1A. In this way, the third left rudder portion 6A and the third right rudder portion 6B may be suppressed from acting as a resistance to sailing of the vessel to sail the vessel efficiently. As used herein, the inner right surface 7A and the inner left surface 7B are collectively referred to as inner surface 7.

Each of the second left rudder portion 5A and the second right rudder portion 5B is preferably formed in an approximately arcuate shape at a radial distance from the tip circle line L of the first propeller 1A. In this way, thrust equivalent to the one produced on both sides in the upper part of the duct arranged along the tip circle of the propeller of a ducted propeller may be produced on the second left rudder portion 5A and the second right rudder portion 5B.

As shown in FIG. 4, which is a left side view, in the front-back direction, the left rudder chord length ("a dimension in a front-back direction" in the claims) CA of the third left rudder portion 6A is preferably 40 to 100% of the diameter D of the first propeller 1A, like the duct length of a ducted propeller. In this way, thrust may be exerted efficiently on the third left rudder portion 6A.

The first propeller 1A is arranged within 15 to 65% of the left rudder chord length CA from the leading edge of the third left rudder portion 6A, i.e., the leading end F of the blades of the first propeller 1A is positioned on the trailing side of 15% of the left rudder chord length CA from the leading edge of the third left rudder portion 6A, while the trailing end E of the blades of the first propeller 1A is positioned on the leading side of 65% of the left rudder chord length CA from the leading edge of the third left rudder portion 6A.

The left rudder shaft 8A is located within 30 to 50% of the left rudder chord length CA from the leading edge of the third left rudder portion 6A, in particular, preferably located within 35 to 45% of the left rudder chord length CA from the leading edge of the third left rudder portion 6A. In this way, the torque to turn the left rudder shaft 8A by the left steering machine 10A may be rendered small, and significant rudder force may be produced on the third left rudder portion 6A upon steering ahead, to thereby stop the vessel efficiently.

Similarly, as shown in FIG. 5, which is a right side view, in the front-back direction, the right rudder chord length ("a dimension in a front-back direction" in the claims) CB of the third right rudder portion 6B is preferably 40 to 100% of the diameter D of the first propeller 1A. In this way, thrust may be exerted efficiently on the third right rudder portion 6B. As used herein, the left rudder chord length CA and the right rudder chord length CB are collectively referred to as rudder chord length C.

The first propeller 1A is arranged within 15 to 65% of the right rudder chord length CB from the leading edge of the third right rudder portion 6B, i.e., the leading end F of the blades of the first propeller 1A is positioned on the trailing side of 15% of the right rudder chord length CB from the leading edge of the third right rudder portion 6B, while the trailing end E of the blades of the first propeller 1A is positioned on the leading side of 65% of the right rudder chord length CB from the leading edge of the third right rudder portion 6B.

The right rudder shaft 8B is located within 30 to 50% of the right rudder chord length CB from the leading edge of the third right rudder portion 6B, in particular, preferably located within 35 to 45% of the right rudder chord length CB from the leading edge of the third right rudder portion 6B. In this way, the torque to turn the right rudder shaft 8B by the right steering machine 10B may be rendered small, and significant rudder force may be produced at the third right rudder portion 6B upon steering ahead, to thereby stop the vessel efficiently.

As shown in FIG. 6, which is a plan view, the inner right surface 7A of the third left rudder portion 6A is formed with a camber line profile having a certain protrusion toward the first propeller 1A. In this way, forward right thrust may be produced efficiently on the third left rudder portion 6A. In addition, the suction flow generated on the leading edge side of the inner right surface 7A of the third left rudder portion 6A by the first propeller 1A causes the Coanda effect to thereby enhance the thrust still more.

The third left rudder portion 6A is preferably formed with a particular torsion angle, preferably with the torsion angle in the upper part thereof larger than the torsion angle in the lower part thereof, and the third left rudder portion 6A is formed with the torsion angle in the upper part thereof being 7 degrees and the torsion angle in the lower part thereof being 3 degrees.

The left rudder shaft 8A is configured to be turned through the negative rudder angle of 0 to 15 degrees and through the positive rudder angle of 0 to 105 degrees by the left steering machine 10A. It should be understood that the negative rudder angle is a rudder angle resulting from clockwise turning of the left rudder shaft 8A for steering ahead, whereas the positive rudder angle is a rudder angle resulting from counter-clockwise turning of the left rudder shaft 8A for steering astern.

In this way, it is possible to limit enhancement of the cavitation, which may cause vibration or noise. The cavitation occurs as follows. When the left rudder shaft 8A is turned excessively clockwise to bring the leading part of the third left rudder portion 6A excessively closer to the stern of the vessel, turbulence occurs in the flow field of the suction flow into the first propeller 1A to generate the cavitation.

Similarly, in a plan view, the inner left surface 7B of the third right rudder portion 8B is formed with a camber line profile having a certain protrusion toward the first propeller 1A. In this way, forward left thrust may be produced efficiently on the third right rudder portion 6B. In addition, the suction flow generated on the leading edge side of the inner left surface 7B of the third right rudder portion 6B by the first propeller 1A causes the Coanda effect to thereby enhance the thrust still more.

The third right rudder portion 6B is preferably formed with a particular torsion angle, preferably the torsion angle in the upper part thereof is formed larger than the torsion angle in the lower part thereof, and the third right rudder portion 6B is formed with the torsion angle in the upper part thereof being 7 degrees and the torsion angle in the lower part thereof being 3 degrees.

The right rudder shaft 8B is configured to be turned through a negative rudder angle of 0 to 15 degrees and through a positive rudder angle of 0 to 105 degrees with the right steering machine 10B being driven. It should be understood that the negative rudder angle is a rudder angle resulting from counter-clockwise turning of the right rudder shaft 8B for steering ahead, whereas the positive rudder angle is a rudder angle resulting from clockwise turning of the right rudder shaft 8B for steering astern.

In this way, it is possible to limit enhancement of the cavitation, which may cause vibration or noise. The cavitation occurs as follows. When the right rudder shaft 8B is turned excessively counter-clockwise to bring the leading part of the third right rudder portion 6B excessively closer to the stern of the vessel, turbulence occurs in the flow field of the suction flow into the first propeller 1A to generate the cavitation.

As shown in FIG. 9, the rudder force produced with the leading part of the third left rudder portion 6A positioned to the forward right of its trailing part by turning the left rudder shaft 8A through a negative rudder angle is larger than the rudder force produced with the leading part of the third left rudder portion 6A positioned to the forward left of its trailing part by turning the left rudder shaft 8A through a positive rudder angle. For example, the rudder force produced by turning the left rudder shaft 8A through the negative rudder angle of 10 degrees is about 0.005 kg, whereas the rudder force produced by turning the left rudder shaft 8A through the positive rudder angle of 10 degrees is about 0.0025 kg.

Similarly, the rudder force produced with the leading part of the third right rudder portion 6B positioned to the forward left of its training part by turning the right rudder shaft 8B through a negative rudder angle is larger than the rudder force produced with the leading part of the third right rudder portion 6B positioned to the forward right of its trailing part by turning the right rudder shaft 8B through a positive rudder angle. For example, the rudder force produced by turning the right rudder shaft 8B through the negative rudder angle of 10 degrees is about 0.005 kg, whereas the rudder force produced by turning the right rudder shaft 8B through the positive rudder angle of 10 degrees is about 0.0025 kg.

In stopping of the vessel, the left steering machine 10A is driven to turn the left rudder shaft 8A through the negative rudder angle of 15 degrees and the right steering machine 10B is driven to turn the right rudder shaft 8B through the negative rudder angle of 15 degrees. In this way, the water flow from forward of the vessel, which promotes idling of the first propeller 1A, is blocked to decrease the inertial force of the first propeller 1A, to thereby enhance the stopping performance of the vessel.

RUDDER ASSEMBLY ACCORDING TO SECOND EMBODIMENT

Next, the rudder assembly according to the second embodiment is discussed. The same members as those in the first embodiment are referred to by the same reference signs, and explanations thereof are omitted.

As shown in FIG. 10, at the stern of the vessel, a first rudder unit 12A constituting a rudder assembly according to the second embodiment is provided around the tip circle of the first propeller 1A, and a second rudder unit 12B constituting the rudder assembly according to the second embodiment is provided around the tip circle of the second propeller 1B.

The first rudder unit 12A and the second rudder unit 12B are formed in lateral symmetry with respect to the center line passing the middle of the right-left direction between the first propeller 1A and the second propeller 1B. As used herein, the first rudder unit 12A and the second rudder unit 12B are collectively referred to as rudder unit 12.

The first rudder unit 12A is composed of a left rudder 3A arranged on the left of the first propeller 1A, without a right rudder corresponding to the right rudder 3B of the first rudder unit 2A according to the first embodiment. The second rudder unit 12B is composed of a right rudder 3B arranged on the right of the second propeller 1B, without a left rudder corresponding to the left rudder 3A of the second rudder unit 2B according to the first embodiment. The left rudder 3A of the first rudder unit 12A is formed in the same shape as the left rudder 3A of the first rudder unit 2A, and the right rudder 3B of the second rudder unit 12B is formed in the same shape as the right rudder 3B of the second rudder unit 2B.

In this way, the first rudder unit 12A and the second rudder unit 12B may be suppressed from acting as a resistance to sailing of the vessel to sail the vessel efficiently. In addition, the left rudder 3A of the first rudder unit 12A and the right rudder 3B of the second rudder unit 12B are arranged spaced widely apart from each other in the right-left direction, so that wider ranges of motion through positive rudder angles may be allowed for the left rudder 3A of the first rudder unit 12A and the right rudder 3B of the second rudder unit 12B.

RUDDER ASSEMBLY ACCORDING TO THIRD EMBODIMENT

Next, the rudder assembly according to the third embodiment is discussed. The same members as those in the first embodiment are referred to by the same reference signs, and explanations thereof are omitted.

As shown in FIG. 11, a first rudder unit 22A constituting a rudder assembly according to the third embodiment is provided around the tip circle of the first propeller 1A, and a second rudder unit 22B constituting the rudder assembly according to the third embodiment is provided around the tip circle of the second propeller 1B.

The first rudder unit 22A and the second rudder unit 22B are formed in lateral symmetry with respect to the center line passing the middle of the right-left direction between the first propeller 1A and the second propeller 1B. As used herein, the first rudder unit 22A and the second rudder unit 22B are collectively referred to as rudder unit 22.

The first rudder unit 22A is composed of a left rudder 3A arranged on the left of the first propeller 1A and a right fixed rudder 23 vertically extending in the middle of the right-left direction between the first propeller 1A and the second propeller 1B.

In the vertical direction, the lower end of the right fixed rudder 23 is arranged aligned to the lower end of the left rudder 3A, and in the front-back direction, the right ridder chord length of the right fixed rudder 23 is the same as the left rudder chord length of the left rudder 3A. The inner left surface 23A of the right fixed rudder 23 is preferably formed with a camber line profile having a certain protrusion toward the first propeller 1A.

The second rudder unit 22B is composed of a right rudder 3B arranged on the right of the second propeller 1B and a left fixed rudder 24 vertically extending in the middle of the right-left direction between the first propeller 1A and the second propeller 1B.

In the vertical direction, the lower end of the left fixed rudder 24 is arranged aligned to the lower end of the right rudder 3B, and in the front-back direction, the left rudder chord length of the left fixed rudder 24 is the same as the right rudder chord length of the right rudder 3B. The inner right surface 24A of the left fixed rudder 24 is preferably formed with a camber line profile having a certain protrusion toward the second propeller 1B. Note that the right fixed rudder 23 and the left fixed rudder 24 are integrally formed to constitute a fixed rudder 25. Alternatively, the fixed rudder 25 may be formed as a normal rudder having the rudder shaft and the rudder plate arranged in the same plane.

In this way, the first rudder unit 22A and the second rudder unit 22B may be suppressed from acting as a resistance to sailing of the vessel to sail the vessel efficiently. In addition, the left rudder 3A of the first rudder unit 22A and the fixed rudder 25 are arranged spaced widely apart from each other in the right-left direction, so that a wider range of motion through a positive rudder angle may be allowed for the left rudder 3A of the first rudder unit 22A, whereas the right rudder 3B of the second rudder unit 22B and the fixed rudder 25 are arranged spaced widely apart from each other in the right-left direction, so that a wider range of motion through a positive rudder angle may be allowed for the right rudder 3B of the second rudder unit 22B.

INDUSTRIAL APPLICABILITY

The present invention is applicable to a vessel equipped with a plurality of propellers arranged in the right-left direction at the stern.

DESCRIPTION OF REFERENCE SIGNS

1A: first propeller
1B: second propeller
2A: first rudder unit
2B: second rudder unit
3A: left rudder
3B: right rudder
4A: first left rudder portion 4B: first right rudder portion
5A: second left rudder portion
5B: second right rudder portion
6A: third left rudder portion
6B: third right rudder portion
7A: inner right surface
7B: inner left surface
8A: left rudder shaft
8B: right rudder shaft
25: fixed rudder
CA: left rudder chord length (dimension in the front-back direction)
CB: right rudder chord length (dimension in the front-back direction)
D: diameter
L: tip circle line

The invention claimed is:

1. A rudder assembly to be arranged on a side of first and second propellers provided at a stern of a vessel at a distance in a right-left direction from each other and aligned at a same front-back position, the rudder assembly comprising:

a first rudder unit to be arranged on both sides of the first propeller; and a second rudder unit to be arranged on both sides of the second propeller, wherein the first rudder unit includes, as seen from rear, a left rudder to be arranged on a left of the first propeller and a right rudder to be arranged on a right of the first propeller, wherein the second rudder unit includes, as seen from rear, a left rudder to be arranged on a left of the second propeller and a right rudder to be arranged on a right of the second propeller, wherein each left rudder of the first and second rudder units includes, as seen from rear, a first left rudder portion extending in the right-left direction, a second left rudder portion curved from a left end of the first left rudder portion toward lower left, and a third left rudder portion extending downwards from a lower end of the second left rudder portion, and each right rudder of the first and second rudder units comprising, as seen from rear, a first right rudder portion extending in the right-left direction, a second right rudder portion curved from a right end of the first right rudder portion toward lower right, and a third right rudder portion extending downwards from a lower end of the second right rudder portion, wherein, as seen from rear, lower surface of the first left rudder portion and the first right rudder portion of the first rudder unit are arranged at positions spaced upwardly apart from an upper edge of a tip circle line of the first propeller for a distance of 10 to 20% of a diameter of the first propeller, and wherein, as seen from rear, lower surfaces of the first left rudder portion and the first right rudder portion of the second rudder unit are arranged at positions spaced upwardly apart from an upper edge of a tip circle line of the second propeller for a distance of 10 to 20% of a diameter of the second propeller.

2. The rudder assembly according to claim 1, further comprising:

a left rudder shaft and a right rudder shaft provided in the first left rudder portion and the first right rudder portion, respectively, of the first rudder unit, wherein, as seen from side, dimensions in a front-back direction of the third left rudder portion and the third right rudder portion of the first rudder unit are 40 to 100% of the diameter of the first propeller, the first propeller is arranged within 15 to 65% of the dimension in the front-back direction from leading edges of the third left rudder portion and the third right rudder portion of the first rudder unit, and the left rudder shaft and the right rudder shaft of the first rudder unit are located within 30 to 50% the dimension in the front-back direction from the leading edges of the third left rudder portion and the third right rudder portion, respectively, of the first rudder unit, the rudder assembly further comprising:

a left rudder shaft and a right rudder shaft provided in the first left rudder portion and the first right rudder portion, respectively, of the second rudder unit, wherein, as seen from side, dimensions in a front-back direction of the third left rudder portion and the third right rudder portion of the second rudder unit are 40 to 100% of the diameter of the second propeller, the second propeller is arranged within 15 to 65% of the dimension in the front-back direction from leading edges of the third left rudder portion and the third right rudder portion of the second rudder unit, and the left rudder shaft and the right rudder shaft of the second rudder unit are located within 30 to 50% the dimension in the front-back direction from leading edges of the third left rudder portion and the third right rudder portion, respectively, of the second rudder unit.

3. The rudder assembly according to claim 2, wherein, as seen from rear, a distance between an inner right surface of the third left rudder portion of the first rudder unit and a left edge of the tip circle line of the first propeller, and a distance between an inner left surface of the third right rudder portion of the first rudder unit and a right edge of the tip circle line of the first propeller are 4 to 10% of the diameter of the first propeller, and wherein, as seen from rear, a distance between an inner right surface of the third left rudder portion of the second rudder unit and a left edge of the tip circle line of the second propeller, and a distance between an inner left surface of the third right rudder portion of the second rudder unit and a right edge of the tip circle line of the second propeller are 4 to 10% of the diameter of the second propeller.

4. The rudder assembly according to claim 2, wherein, as seen from rear, lower ends of the third left rudder portion and the third right rudder portion of the first rudder unit are positioned below a shaft center of the first propeller, and wherein, as seen from rear, lower ends of the third left rudder portion and the third right rudder portion of the second rudder unit are positioned below a shaft center of the first propeller.

5. The rudder assembly according to claim 2, wherein, as seen from rear, the first rudder unit includes the left rudder to be arranged on a left of the first propeller, and wherein, as seen from rear, the second rudder unit includes the right rudder to be arranged on a right of the second propeller.

6. The rudder assembly according to claim 1, wherein, as seen from rear, a distance between an inner right surface of the third left rudder portion of the first rudder unit and a left edge of the tip circle line of the first propeller, and a distance between an inner left surface of the third right rudder portion of the first rudder unit and a right edge of the tip circle line of the first propeller are 4 to 10% of the diameter of the first propeller, and wherein, as seen from rear, a distance between an inner right surface of the third left rudder portion of the second rudder unit and a left edge of the tip circle line of the second propeller, and a distance between an inner left surface of the third right rudder portion of the second rudder unit and a right edge of the tip circle line of the second propeller are 4 to 10% of the diameter of the second propeller.

7. The rudder assembly according to claim 6, wherein, as seen from rear, lower ends of the third left rudder portion and the third right rudder portion of the first rudder unit are positioned below a shaft center of the first propeller, and wherein, as seen from rear, lower ends of the third left rudder portion and the third right rudder portion of the second rudder unit are positioned below a shaft center of the first propeller.

8. The rudder assembly according to claim 6, wherein, as seen from rear, the first rudder unit includes the left rudder to be arranged on a left of the first propeller, and wherein, as seen from rear, the second rudder unit includes the right rudder to be arranged on a right of the second propeller.

9. The rudder assembly according to claim 1, wherein, as seen from rear, lower ends of the third left rudder portion and the third right rudder portion of the first rudder unit are positioned below a shaft center of the first propeller, and wherein, as seen from rear, lower ends of the third left rudder portion and the third right rudder portion of the second rudder unit are positioned below a shaft center of the first propeller.

10. The rudder assembly according to claim 9, wherein, as seen from rear, the first rudder unit includes the left rudder to be arranged on a left of the first propeller, and wherein, as seen from rear, the second rudder unit includes the right rudder to be arranged on a right of the second propeller.

11. The rudder assembly according to claim 10, comprising:

a fixed rudder having a rudder shaft and a rudder plate in a same plane, and provided between the left rudder of the first rudder unit and the right rudder of the second rudder unit, wherein, as seen from rear, the fixed rudder is positioned in a middle of the right-left direction between the first propeller and the second propeller.

12. The rudder assembly according to claim 1, wherein, as seen from rear, the first rudder unit includes the left rudder to be arranged on a left of the first propeller, and wherein, as seen from rear, the second rudder unit includes the right rudder to be arranged on a right of the second propeller.

13. The rudder assembly according to claim 12, comprising:

a fixed rudder having a rudder shaft and a rudder plate in a same plane, and provided between the left rudder of the first rudder unit and the right rudder of the second rudder unit, wherein, as seen from rear, the fixed rudder is positioned in a middle of the right-left direction between the first propeller and the second propeller.

14. The rudder assembly according to claim 1, wherein, as seen from side, a leading part and a trailing part of the third left rudder portion of the first rudder unit are formed downwardly linearly from a lower end of the second left rudder portion of the first rudder unit, whereas a leading part and a trailing part of the third right rudder portion of the first rudder unit are formed downwardly linearly from a lower end of the second right rudder portion of the first rudder unit, and wherein, as seen from side, a leading part and a trailing part of the third left rudder portion of the second rudder unit are formed downwardly linearly from a lower end of the second left rudder portion of the second rudder unit, whereas a leading part and a trailing part of the third right rudder portion of the second rudder unit are formed downwardly linearly from a lower end of the second right rudder portion of the second rudder unit.

* * * * *